US006021287A

United States Patent [19]

Tanaka

[11] Patent Number: 6,021,287

[45] Date of Patent: Feb. 1, 2000

[54] IMAGE FORMING APPARATUS HAVING TRANSFER DEVICES AND METHOD FOR SETTING TRANSFER VOLTAGE APPLIED TO THE TRANSFER DEVICES

[75] Inventor: Yasuo Tanaka, Okazaki, Japan

[73] Assignee: Minolta Co., Ltd., Osaka, Japan

[21] Appl. No.: 09/229,648

[22] Filed: Jan. 13, 1999

[30] Foreign Application Priority Data

Jan. 19, 1998 [JP] Japan ..... 10-007459

[51] Int. Cl.[7] ..... G03G 15/16

[52] U.S. Cl. ..... 399/66; 399/299; 399/310; 399/314

[58] Field of Search ..... 399/66, 314, 313, 399/310, 299, 297, 302, 308

[56] References Cited

U.S. PATENT DOCUMENTS

| | | | |
|---|---|---|---|
| 5,041,877 | 8/1991 | Matsumoto | 399/66 |
| 5,119,139 | 6/1992 | Torisawa | 399/299 |
| 5,469,248 | 11/1995 | Fujiwara et al. | 399/314 |
| 5,600,421 | 2/1997 | Takekoshi et al. | 399/66 |
| 5,794,110 | 8/1998 | Kasai et al. | 399/299 |
| 5,822,648 | 10/1998 | Mohri | 399/66 X |

FOREIGN PATENT DOCUMENTS

| | | |
|---|---|---|
| 02123385 | 5/1990 | Japan . |
| 02212872 | 8/1990 | Japan . |
| 5-341669 | 12/1993 | Japan . |
| 7-333942 | 12/1995 | Japan . |
| 10-104970 | 4/1998 | Japan . |
| 10-228186 | 8/1998 | Japan . |

*Primary Examiner*—Matthew S. Smith
*Attorney, Agent, or Firm*—McDermott, Will & Emery

[57] ABSTRACT

In an image forming apparatus, toner images respectively formed on a plurality of photosensitive components set along a transport belt are transferred onto a recording sheet transported on the transport belt by means of electric fields generated by a plurality of transfer devices set corresponding to the plurality of photosensitive components. The toner images are superimposed to form a color image. The image forming apparatus includes a current supplying device for supplying a constant current to the one of the plurality of transfer devices and to each of the plurality of transfer devices that is adjacent to the one of the plurality of transfer devices when a toner image transfer is not being performed by the plurality of transfer devices, a detecting device for detecting a voltage across one of the plurality of transfer devices when the constant current is supplied by the current supplying device, and a voltage setting device for setting a specific voltage to be applied to the one of the plurality of transfer devices in accordance with the voltage detected by the detecting device, the specific voltage being used for the generation of the electric field.

14 Claims, 7 Drawing Sheets

IMAGE FORMING APPARATUS HAVING TRANSFER DEVICES AND METHOD FOR SETTING TRANSFER VOLTAGE APPLIED TO THE TRANSFER DEVICES

This application is based on an application No. 10-7459 filed in Japan, the content of which is hereby incorporated by reference.

BACKGROUND OF THE INVENTION (1) Field of the Invention

The present invention relates to an image forming apparatus, such as a copier and a printer, and particularly relates to an improvement on a transfer technique used by an image forming apparatus in which toner images are transferred at a plurality of positions, such as a tandem-type image forming apparatus.

(2) Description of the Related Art

When a toner image transfer is performed using the electrostatic transfer method, a toner image formed on a photosensitive drum is transferred onto a recording sheet as one example of conventional ways. Specifically, a transfer roller, which is set facing the photosensitive drum, applies an electric field so that the polarity of the transfer roller side is opposite to the polarity of toner. By means of an action of the electric field, the toner on the surface of the photosensitive drum is attracted to a surface of a recording sheet which passes between the photosensitive drum and the transfer roller.

Here, the resistance of the transfer roller varies with surrounding conditions, such as temperature and humidity. As such, the transfer current varies even though the voltage applied to the transfer roller is controlled to be constant, thereby making the toner image transfer unstable.

Tandem-type color copiers have received much attention in recent years as image forming apparatuses which can perform color printing at high speed. However, the stated problem occurs to a tandem-type color copier having transfer devices corresponding to photosensitive drums set along a transport belt.

To address this problem, Japanese Laid-Open Patent Applications No. 2-123385 and No. 7-120117 teach the following method although each of their inventions relates to a copier having a single transfer device, and does not relate to a copier having transfer devices such as a tandem-type copier.

More specifically, before an image forming process is executed, an optimum current is applied to the transfer roller and a voltage obtained by means of the application of the optimum current is measured. Then, a voltage (i.e., an optimum voltage) based on the measurement result is applied to the transfer roller when the image forming process is executed. By this method, excellent toner image transfer can be performed regardless of the change in the surrounding conditions.

However, using the image forming apparatus such as the tandem-type color copier, transfer deterioration still occurs even when image formation is executed after the optimum voltage is obtained for each transfer roller using the stated method, since more than one transfer device (or, transfer roller) is provided.

SUMMARY OF THE INVENTION

The first object of the present invention is to provide an image forming apparatus by which transfer deterioration is prevented and reproduced images of high quality are obtained even if the image forming apparatus is provided with a plurality of transfer devices.

The first object of the present invention can be achieved by an image forming apparatus made up of: an image holding system for holding toner images; a plurality of transfer devices for transferring the toner images held on the image holding system onto a transfer medium; a current supplying device for supplying a constant current to one of the plurality of transfer devices and to each of the plurality of transfer devices that is adjacent to the one of the plurality of transfer devices when a toner image transfer is not being performed by the plurality of transfer devices; a detecting device for detecting a voltage across the one of the plurality of transfer devices when the constant current is supplied by the current supplying device; and a voltage setting device for setting a specific voltage to be applied to the one of the plurality of transfer devices in accordance with the voltage detected by the detecting device, the specific voltage being used for the toner image transfer.

The first object of the present invention can be also achieved by an image forming apparatus made up of: a first image holding component for holding a first toner image; a second image holding component for holding a second toner image; a first transfer device for transferring the first toner image from the first image holding component onto a transfer medium; a second transfer device for transferring the second toner image from the second image holding component onto the transfer medium; a current supplying device for supplying a constant current to the first transfer device and to the second transfer device when neither of the first transfer device nor the second transfer device is performing a toner image transfer; a detecting device for detecting a voltage across the first transfer device when the constant current is supplied by the current supplying device; and a voltage setting device for setting a specific voltage to be applied to the first transfer device in accordance with the voltage detected by the detecting device, the specific voltage being used for the toner image transfer.

The first object of the present invention can be also achieved by an image forming apparatus made up of: an image holding component for holding a toner image; a transfer medium; a first transfer device for transferring the toner image from the image holding component onto the transfer medium; a second transfer device for transferring the toner image formed on the transfer medium onto a record medium; a current supplying device for supplying a constant current to the first transfer device and to the second transfer device when neither of the first transfer device nor the second transfer device is performing a toner image transfer; a detecting device for detecting a voltage across the first transfer device when the constant current is supplied by the current supplying device; and a voltage setting device for setting a specific voltage to be applied to the first transfer device in accordance with the voltage detected by the detecting device, the specific voltage being used for the toner image transfer.

The second object of the present invention is to provide a method for setting an optimum transfer voltage to be applied to a plurality of transfer devices of an image forming apparatus so that transfer deterioration is prevented.

The second object of the present invention can be achieved by a constant voltage setting method of setting a constant voltage for an image forming apparatus in which toner images formed on an image holding system are sequentially transferred onto a transfer medium by a plurality of transfer devices to which the constant voltage is applied, the constant voltage setting method including: a first step for supplying a constant current to one of the plurality of the transfer devices which is subject to a voltage setting and to each of the plurality of the transfer devices which is adjacent to the one of the plurality of transfer devices; a second step for detecting a voltage across the one of the plurality of transfer devices which is subject to the voltage setting when the constant current is supplied; and a third step for setting the constant voltage to be applied to the one of the plurality of transfer devices which is subject to the voltage setting in accordance with the voltage detected in the second step.

The second object of the present invention can be achieved by a constant voltage setting method of setting a constant voltage to be applied to a first transfer device of an image forming apparatus, in which a first toner image formed on a first image holding component is transferred onto a transfer medium by the first transfer device and a second toner image formed on a second image holding component is transferred onto the transfer medium by a second transfer device, with the constant voltage being applied to the first transfer device and the second transfer device, the constant voltage setting method including: a first step for supplying a constant current to the first transfer device and the second transfer device; a second step for detecting a voltage across the first transfer device when the constant current is supplied; and a third step for setting the constant voltage to be applied to the first transfer device in accordance with the voltage detected in the second step.

The second object of the present invention can be also achieved by a constant voltage setting method of setting a constant voltage for an image forming apparatus, in which a toner image formed on an image holding component is transferred onto a transfer medium by a first transfer device and the toner image formed on the transfer medium is transferred onto a record medium by a second transfer device, with the constant voltage being applied to the first transfer device and the second transfer device, the constant voltage setting method including: a first step for supplying a constant current to the first transfer device and the second transfer device; a second step for detecting at least one of voltages across the first transfer device and the second transfer device when the constant current is supplied; and a third step for setting, in accordance with the voltage detected in the second step, the constant voltage to be applied to the at least one of the first transfer device and the second transfer device that is subjected to the detection in the second step.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings.

DESCRIPTION OF PREFERRED EMBODIMENTS

The following is a description of an embodiment of the image forming apparatus of the present invention, with reference to the drawings. Although a tandem-type copier (simply referred to as the "copier" hereinafter) is used as an example of such image forming apparatus in the embodiment, the present invention can be applied to an image forming apparatus such as a printer.

Figure 1:
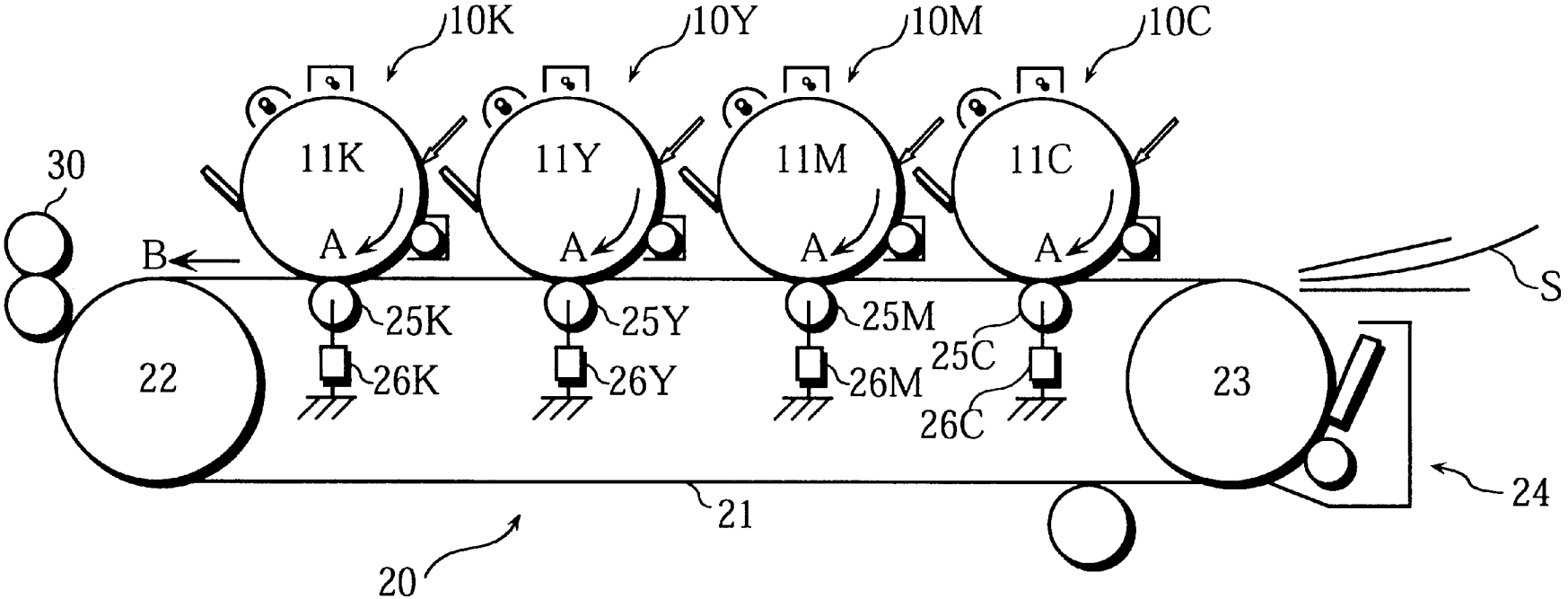
FIG. 1 is a schematic view showing the construction of an image forming section provided in a tandem-type copier of an embodiment of the present invention.

FIG. 1 shows a schematic view showing the construction of an image forming section provided in the copier of the present invention. As shown in FIG. 1, the image forming section is mainly composed of four image forming units 10C to 10K, a transfer unit 20, and a fixing roller 30. A recording sheet S is transported on a transporting belt 21 which is horizontally set in a lower space of an enclosure of the copier. Each of toner images formed on the image forming units 10C to 10K for a different color is transferred onto the recording sheet S to form a color image.

The image forming units 10C to 10K respectively have unit constructions provided with photosensitive drums 11C to 11K as main components, chargers, and developing units. By means of these unit constructions, image formation is performed according to the well-known electrostatic copying method. More specifically, the light-modulated beams expose the surfaces of the photosensitive drums 11C to 11K rotated in the direction of the arrows A shown in FIG. 1. Electrostatic latent images are respectively formed on the surfaces of the photosensitive drums 11C to 11K and then visibly developed into toner images by the developing units. Note that the developing units of the image forming units 10C to 10K respectively supply the photosensitive drums 11C to 11K with C(cyan), M(magenta), Y(yellow), and K(black) toner as developers corresponding to the light-modulated colors.

The transfer unit 20 includes a transport belt 21, a drive roller 22, a slave roller 23, a belt cleaner 24, transfer rollers 25C to 25K, and constant voltage/current power supplies 26C to 26K. The transport belt 21 runs over the drive roller 22 and the slave roller 23. The belt cleaner 24 removes toner particles or dust remaining on the surface of the transport belt 21.

Rubber rollers including carbon as a material are used as the transfer rollers 25C to 25K. The transport belt 21 is made of material with medium resistance whose volume resistivity is approximately $10^4\Omega$.cm to $10^{13}\Omega$.cm.

The negatively charged toner images formed on the photosensitive drums 11C to 11K are transferred onto the recording sheet S transported on the transport belt 21 by means of an action of the electric field applied by the transfer rollers 25C to 25K which are provided on the underside of the transport belt 21. Here, the toner images are sequentially transferred onto the recording sheet S at transfer positions which are respectively located directly under the photosensitive drums 11C to 11K. The recording sheet S is transported by the transport belt 21 in the direction of the arrow B indicated in FIG. 1. After the toner image transfer, the recording sheet S is transported by the transport belt 21 to the fixing unit 30 where the toner image is fixed onto the recording sheet S. Finally, the recording sheet S is discharged onto a discharge tray (not shown).

The constant voltage/current power supplies 26C to 26K are provided corresponding to the transfer rollers 25C to 25K and respectively performs the constant voltage control and the constant current control for the transfer rollers 25C to 25K. Constructions of the constant voltage/current power supplies 26C to 26K are the same, and therefore, only the construction of the constant voltage/current power supply 26C is described as one example.

Figure 2:
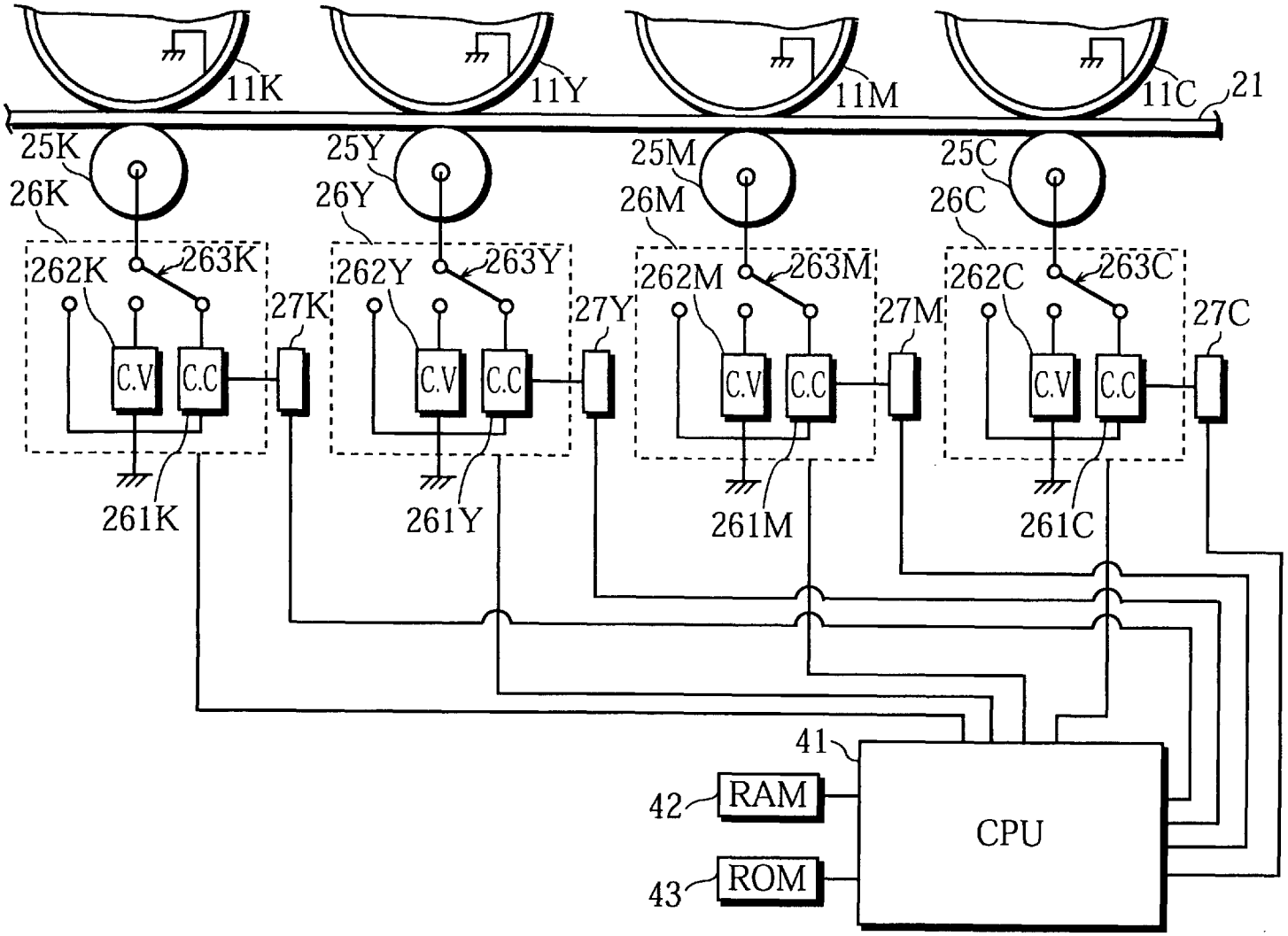
FIG. 2 is a schematic view showing the construction around transfer rollers of the image forming section.

As shown in FIG. 2, the constant voltage/current power supply 26C includes a constant-current control unit 261C, a constant-voltage control unit 262C, and a switch 263C. The constant-current control unit 261C is activated by a CPU 41 described later and applies a predetermined current equivalent to an optimum transfer current to the transfer roller 25C. Although the predetermined current varies with kinds of copiers due to different components provided, it can be easily obtained through experiments.

The constant-voltage control unit 262C is activated by the CPU 41 and performs voltage control so that a constant voltage according to a voltage setting signal outputted from the CPU 41 is applied to the transfer roller 25C.

An electromagnetic relay or the like is used as the switch 263C. In accordance with a switching signal outputted from the CPU 41, the transfer roller 25C is connected to the constant-current control unit 261C, the constant-voltage control unit 262C, or a ground.

A state where the switch is connected to the corresponding ground is referred to as a state where "the constant voltage/current power supplies are turned off". A state where the switch is connected to the corresponding constant-current control unit is referred to as a state where "the constant-current power supply is turned on". A state where the switch is connected to the corresponding constant-voltage control unit is referred to as a state where "the constant-voltage power supply is turned on".

Voltage measuring units 27C to 27K are provided corresponding to the transfer rollers 25C to 25K for measuring the voltage of the transfer rollers 25C to 25K. The measurement results are outputted to the CPU 41.

The CPU 41 is connected to a RAM 42 for serving as a work area of the CPU 41 and a ROM 43 for storing programs. The CPU 41 performs processes according to the programs stored in the ROM 43 when receiving an instruction from a main CPU (not shown) that controls the entire copier. The CPU 41 determines the transfer voltage according to the following processing.

When an instruction is given by the main CPU (not shown), the CPU 41 connects the switches 263C to 263K of the constant voltage/current power supplies 26C to 26K respectively to the constant-current control units 261C to 261K.

With all of the constant-current control units 261C to 261K being activated, the CPU 41 stores the measurement results outputted from the voltage measuring units 27C to 27K into the RAM 42. Here, the measurement results are stored in the RAM 42, being associated with the constant voltage/current power supplies 26C to 26K. Hereinafter, the value of the voltage applied to the transfer roller of the corresponding constant-current control unit that is being activated is referred to as the "voltage standard value" of the transfer roller.

After the measurement, the CPU 41 stops the activation of the constant-current control units 261C to 261K and connects the switches 263C to 263K respectively to the constant-voltage control units 262C to 262K so that the constant-voltage control units 262C to 262K are activated. Then, the CPU 41 outputs the voltage setting signals based on the voltage standard values stored in the RAM 42 to the constant-voltage control units 262C to 262K. In this way, to the transfer rollers 25C to 25K, the constant-voltage control units 262C to 262K respectively apply the transfer voltage responsive to changes of the resistance of the transfer rollers 25C to 25K and the transport belt 21. Accordingly, the appropriate transfer current runs between each of the transfer rollers 25C to 25K and the corresponding photosensitive drum 11C to 11K, so that an excellent transferred image is obtained.

In the present embodiment, the voltage standard values of the transfer rollers 25C to 25K are measured while all of the constant-current power supplies are turned on. As a different method, the voltage standard values can be separately measured while the corresponding constant-current power supply is turned on. In this case, however, the following problem occurs.

As one example, suppose that the voltage standard value of the transfer roller 25C is measured with the constant-current power supply of the transfer roller 25C being on and the constant-current power supplies of the transfer rollers 25M to 25K being off. While doing so, part of the current applied to the transfer roller 25C flows to the constant voltage/current power supply 26M through the transport belt 21 and the adjacent transfer roller 25M. Hereinafter, part of the current that flows to sides except for the corresponding photosensitive drum side is referred to as the "leakage current".

Meanwhile, when the image formation processing is executed, the transfer voltage is applied to all of the transfer rollers 25C to 25K, so that the potential of the underside of the transport belt 21 is approximately the same at each of positions where the transfer rollers 25C to 25K are located. Thus, the transfer current hardly flows to the adjacent transfer roller(s).

This is to say, the voltage to be applied to the transfer roller 25C, i.e., the voltage standard value of the transfer roller 25C, is different between where the transfer voltage is applied to all of the transfer rollers 25C to 25K and where the transfer voltage is applied to only the transfer roller 25C. The transfer voltage based on the voltage standard value which is measured with only the constant-current power supply of the transfer roller 25C being turned on is inappropriate.

In recent years, a distance between the transfer rollers has been shortened in keeping with the current trend towards downsizing, thereby decreasing the resistance of the transport belt located between the transfer rollers. Consequently, the problem caused by the leakage current is more noticeable.

In the present embodiment, on the other hand, the voltage standard values of the transfer rollers 25C to 25K are measured while all of the constant-current power supplies are turned on and the predetermined voltage is applied to the transfer rollers 25C to 25K. The potential of the underside of the transport belt 21 is approximately the same at each of the positions where the transfer rollers 25C to 25K are located. Thus, most of the current applied to each transfer roller by the corresponding constant-current control unit flows to the corresponding photosensitive drum. This is to say, the voltage standard value is measured in the same state where the image formation processing is executed. The image formation is performed using the transfer voltage determined in accordance with the measured voltage standard value, so that an excellent transferred image is obtained.

It should be noted here that the voltage standard value may be measured ① during a warm-up time after the power of the copier is turned on, ② every time a predetermined period of time has elapsed, ③ every time a predetermined number of copies have been made, or ④ before the image formation processing is executed after a copy start key is pressed. In doing so, the voltage standard values of all of the transfer rollers 25C to 25K can be measured at one time, so that time taken for the measurement is reduced and the CPU 41 can immediately proceed to the image formation processing as compared with the case where the measurement is separately performed for each of the transfer rollers 25C to 25K.

The voltage standard values of the transfer rollers 25C to 25K are measured at one time while all of the constant-current power supplies are turned on. However, the same result can be obtained when each constant-current power supply of the transfer roller subject to the measurement and the transfer roller(s) adjacent to the transfer roller subject to the measurement is turned on. Here, the adjacent transfer roller(s) refers to two transfer rollers when the transfer roller subject to the measurement is located between the two transfer rollers, and refers to one adjacent transfer roller when the transfer roller subject to the measurement is located at the frontmost or rearmost position on the transport belt 21 in the transport direction of the recording sheet S.

Figure 3:
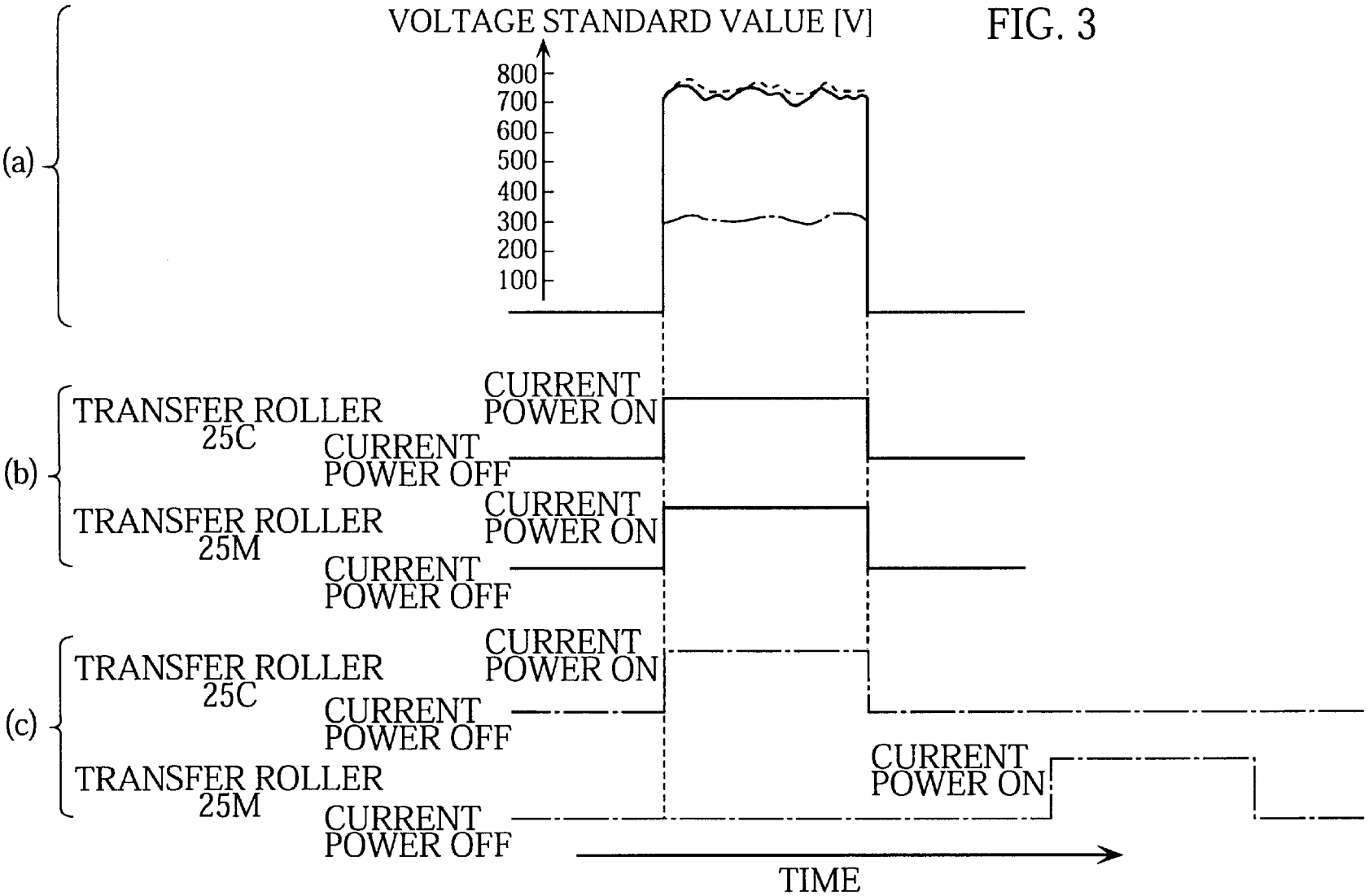
FIG. 3 shows a difference in voltage standard values between when the constant-current power supply of an adjacent transfer roller is turned on and off.

As one example, when the voltage standard value of the transfer roller 25C is measured, the constant-current power supplies of the transfer roller 25C and the transfer roller 25M adjacent to the transfer roller 25C may be turned on. FIG. 3 shows the difference of the voltage standard value of the transfer roller 25C between when the constant-current power supply of the transfer roller 25M is turned on and off. A solid line of the section(a) of FIG. 3 indicated the voltage standard value of the transfer roller 25C when both of the constant-current power supplies of the transfer rollers 25C and 25M are turned on as shown in the section(b) of FIG. 3. A dot-dash line of the section(a) indicates the voltage standard value of the transfer roller 25C when only the constant-current power supply of the transfer roller 25C is turned on as shown in the section(c). A dotted line of the section(a) indicates the voltage value of the transfer roller 25C when most of the current applied to the transfer roller 25C flows to the photosensitive drum 11C without leakage current. This voltage value can be obtained through an experiment where the transfer rollers 25M to 25K are removed, for example.

As seen from FIG. 3, when the voltage standard value of the transfer roller 25C is measured with the constant-current power supply of the transfer roller 25M being on and the predetermined voltage being applied to the transfer roller 25M, the voltage standard value is approximately the same as the value obtained when there is no leakage current. Meanwhile, the voltage standard value obtained when the constant-current power supply of the transfer roller 25M is turned off is less than half the value obtained when there is no leakage current.

Figure 4:
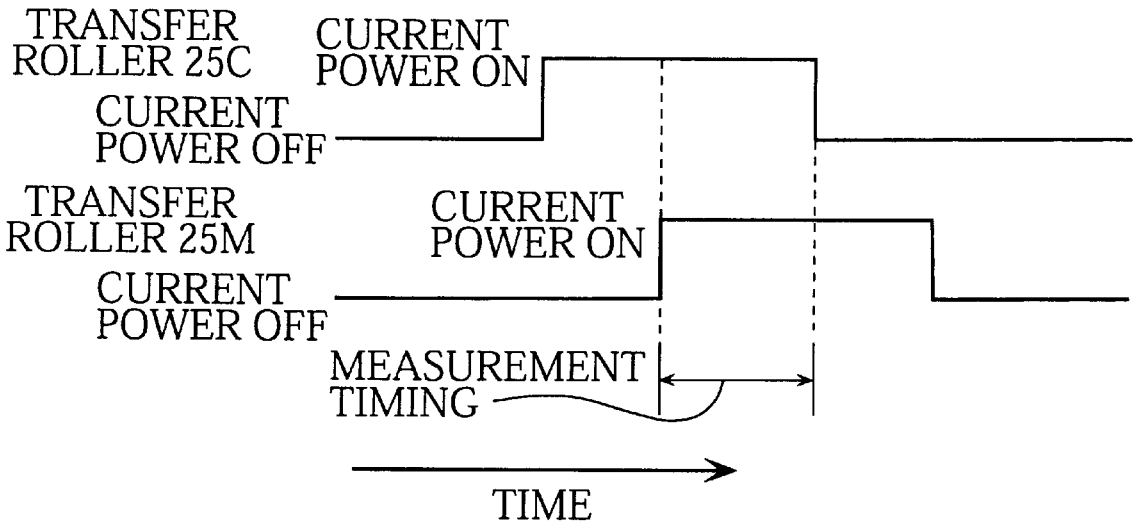
FIG. 4 is a drawing to help explain a timing at which the voltage standard value should be measured.

The constant-current power supplies of the transfer rollers 25C and 25M are turned on at the same timing as shown in the section(b) of FIG. 3. However, they are not necessarily turned on at the same timing. It is essential for time periods when the constant-current power supplies are turned on to partially coincide with one another. As shown in FIG. 4, the voltage standard value can be measured during a time period when both of the constant-current power supplies of the transfer rollers 25C and 25M are turned on.

Figure 5A:
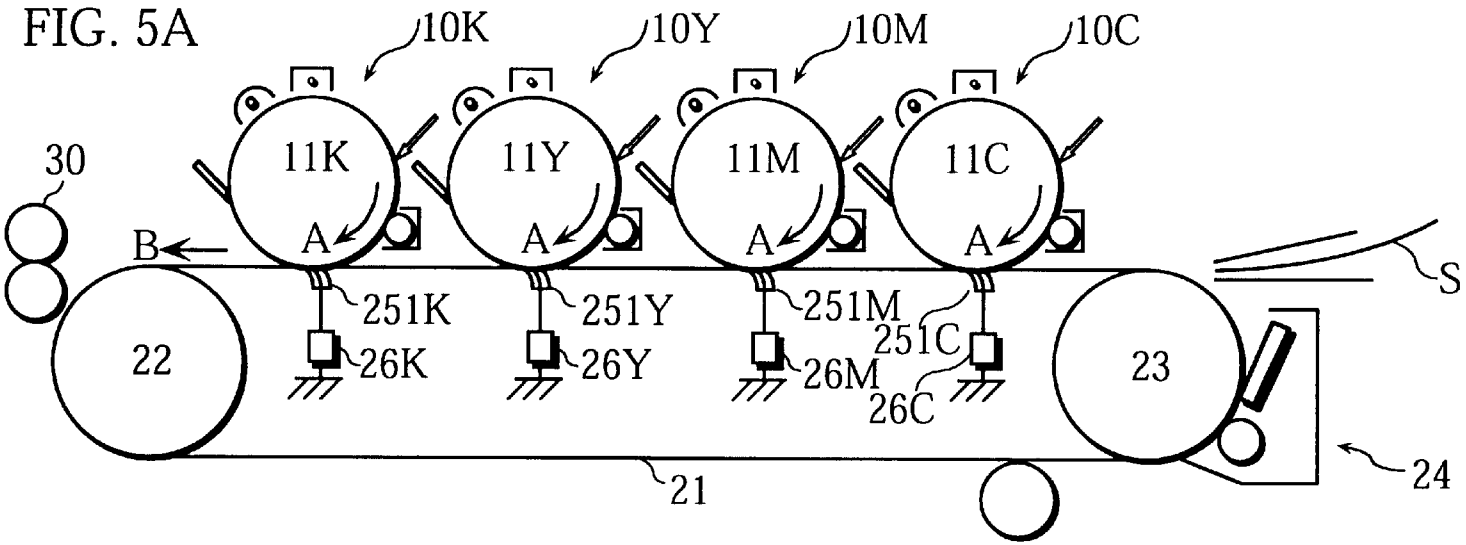
FIG. 5A is a schematic view showing the construction of the image forming section provided with conductive brushes as electric field appliers.
Figure 5B:
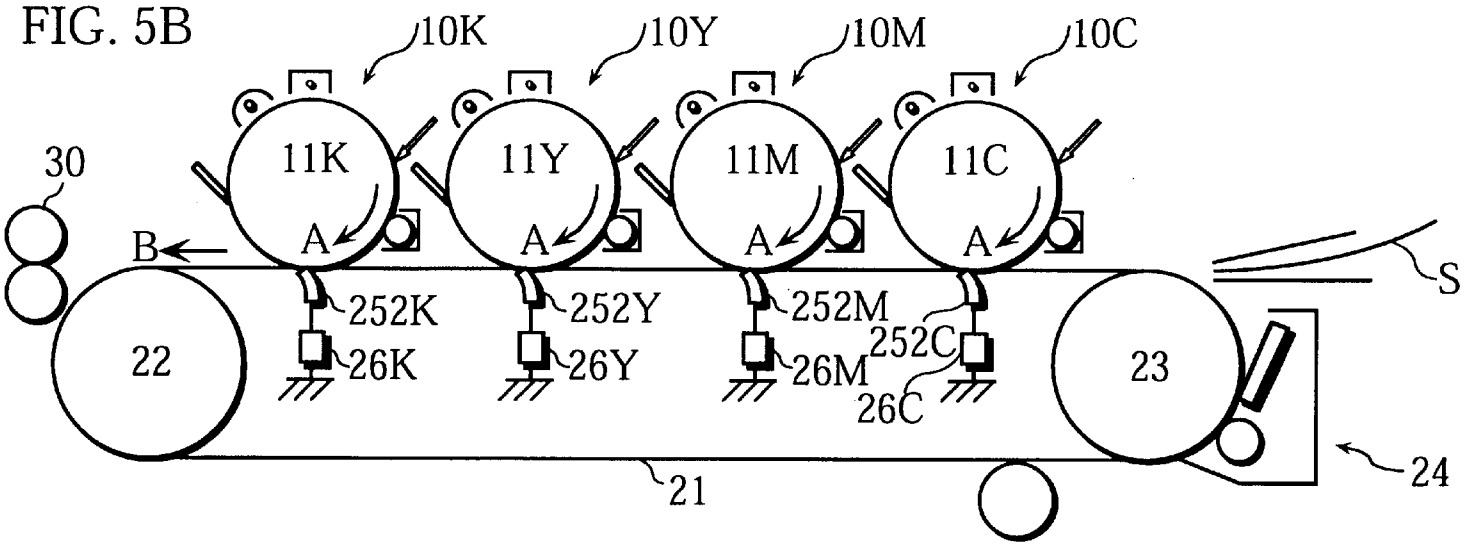
FIG. 5B is a schematic view showing the construction of the image forming section provided with conductive blades as electric field appliers.

Although the transfer rollers (25C to 25K) are used as electric field appliers in the present embodiment, the present invention may be applied to apparatuses that have different electric appliers. For example, brushes 251C to 251K made of conductive fibers can be used as shown in FIG. 5A, and blades 252C to 252K made of conductive resin or conductive rubber can be also used as shown in FIG. 5B. In these cases, aside from the electric field appliers, the respective constructions of the image forming sections are the same as shown in FIG. 1.

Figure 6A:
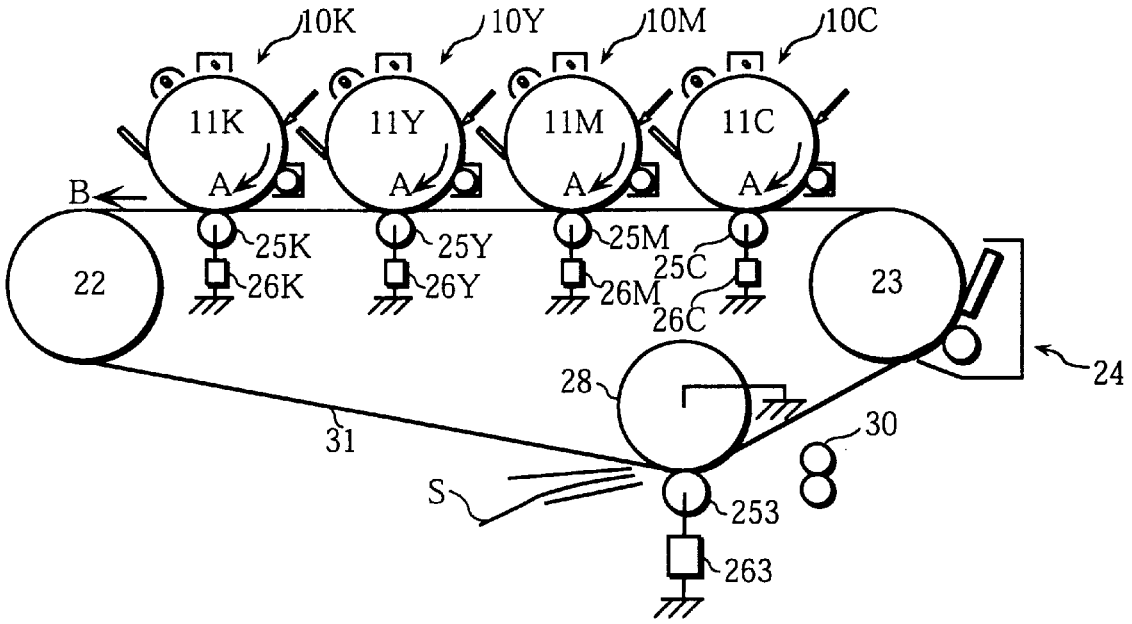
FIG. 6A is a schematic view showing the construction of an image forming section provided in a tandem-type copier of the present invention that uses the intermediate transfer method.

In the present embodiment, the tandem-type copier, in which the toner images formed on the photosensitive drums 11C to 11K are sequentially transferred directly onto the recording sheet S, is used as an example of the present invention. However, the present invention can be applied to a tandem-type copier that employs the intermediate transfer method. More specifically, using the intermediate transfer method, the toner images formed on the photosensitive drums 11C to 11K are first transferred onto a transfer belt (i.e., a transfer intermediate component) and the toner image formed on the transfer belt is then transferred onto the recording sheet S. FIG. 6A is the schematic view showing the construction of an image forming section provided in such tandem-type copier.

The construction of the image forming section shown in FIG. 6A is basically the same as the construction shown in FIG. 1, except that the image forming section of FIG. 6A further includes a backup roller 28 made of conductive material, a secondary transfer roller 253, a constant voltage/current power supply 263, and a transfer belt 31 taking the place of the transport belt 21. Note that the transfer belt 31 is made of the same material as the transport belt 21. The negatively charged toner images formed on the photosensitive drums 11C to 11K are sequentially transferred onto the transfer belt 31 by means of the electric fields applied by the (primary) transfer rollers 25C to 25K set on the underside of the transfer belt 31. Here, the transfer belt 31 moves as the drive roller 22 is rotated. The four-color toner image formed on the transfer belt 31 is transferred onto the recording sheet S by the secondary transfer roller 253 serving as the electric field applier. The recording sheet S is fed in synchronization with a timing at which the four-color toner image is formed on the transfer belt 31. After the toner image transfer, the toner image formed on the recording sheet S is fixed by the fixing roller 30. Finally, the recording sheet S is discharged onto a discharge tray (not shown).

Figure 6B:
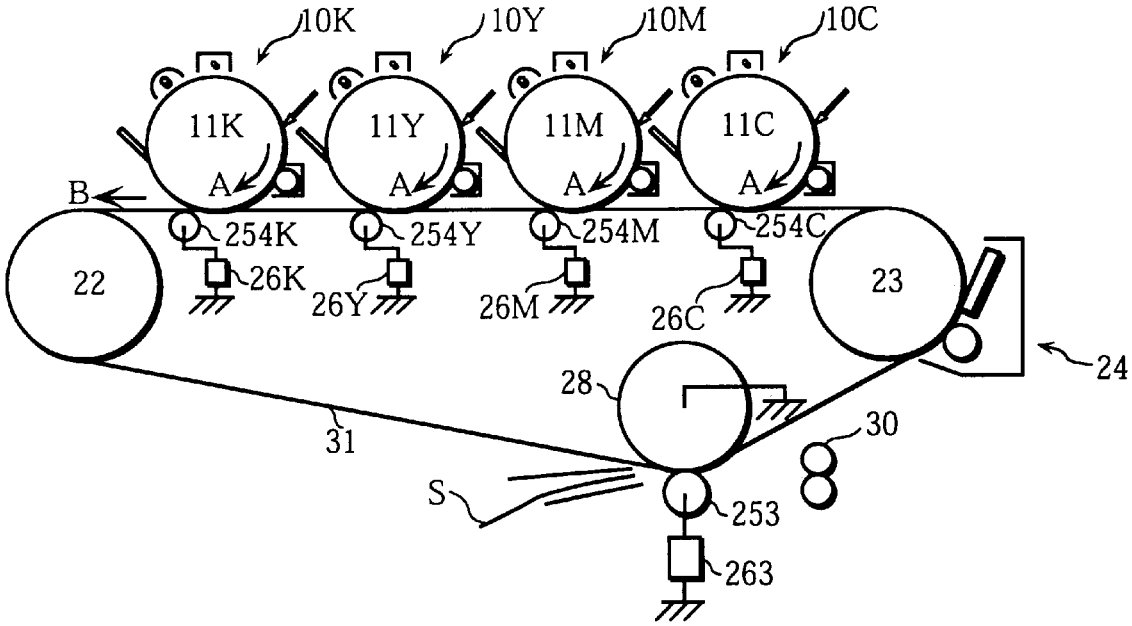
FIG. 6B is a schematic view showing the construction of an image forming section provided in a tandem-type copier of the present invention that uses the intermediate transfer method.

FIG. 6B is also the schematic view showing the construction of an image forming section provided in a tandem-type copier of the present invention that uses the intermediate transfer method. In this tandem-type copier, primary transfer rollers 254C to 254K made of metal material are substituted for the transfer rollers 25C to 25K shown in FIG. 6A. The primary transfer rollers 254C to 254K are set at positions which are 2 mm to 10 mm shifted in the moving direction of the transfer belt 31 from the respective positions located directly under the photosensitive drums. The present invention can be also applied to this kind of tandem-type copiers.

Figure 7:
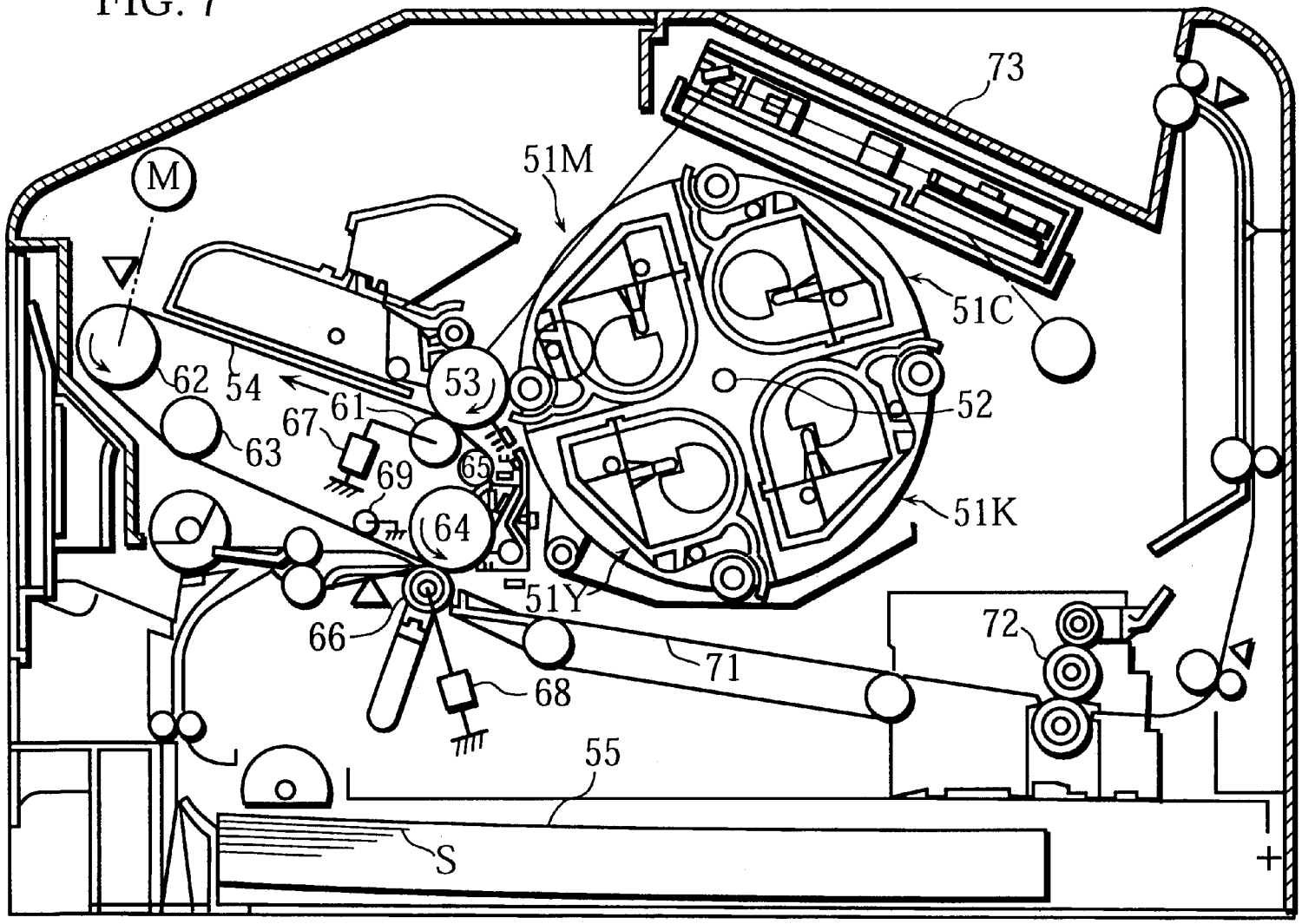
FIG. 7 is a schematic view showing the construction of a color printer of the present invention using the intermediate transfer method that is provided with rotary-type developing units.

The present invention is not limited to the tandem-type color copier, and can be applied to a color printer shown in FIG. 7 that employs the intermediate transfer method. As shown in FIG. 7, the color printer includes the rotary-type developing units.

In the color printer, a plurality of developing units (four developing units 51C to 51K in FIG. 7) are rotated about a rotational shaft 52 so that one of the developing units 51C to 51K corresponding to the reproduction color of the electrostatic latent image formed on a photosensitive drum 53 faces the photosensitive drum 53. The electrostatic latent image is developed by the corresponding developing unit. The developed toner image is transferred onto a transfer belt 54 serving as the transfer intermediate component by a primary transfer roller 61 serving as the electric field applier. The transfer belt 54 runs over rollers 61 to 65 and 69, and is moved as a drive roller 62 is rotated in the direction of the arrow indicated in the FIG. 7. The toner images having been sequentially developed by the developing units 51C to 51K are transferred onto the moving transfer belt 54 one at a time. After the toner image transfer onto the transfer belt 54 for each color, the four-color toner image formed on the transfer belt 54 is transferred onto the recording sheet S by a secondary transfer roller 66 serving as the electric field applier. The recording sheet S is fed from a paper supplying cassette 55 in synchronization with a timing at which the four-color toner image is formed on the transfer belt 54. A backup roller 64, which is set facing the secondary transfer roller 66, is made of insulating material, such as rubber. The backup roller 64 is not grounded and is electrically in a floating state. For this reason, a ground electrode roller 69 is set before the secondary transfer roller 66 in the moving direction of the transfer belt 54, so that the transfer current applied by the secondary transfer roller 66 flows to the ground electrode roller 69. The recording sheet S, on which the toner image has been transferred, is transported by a transport belt 71 to a fixing roller 72 where the toner image is fixed onto the recording sheet S. Then, the recording sheet S is discharged onto a discharge tray 73.

The primary transfer roller 61 and the secondary transfer roller 66 are respectively provided with constant voltage/current power supplies 67 and 68 that have the same construction as shown in FIG. 1. A CPU (not shown) controls the constant voltage/current power supplies 67 and 68.

When two transfer units (the transfer rollers, in this case) are set relatively close to each other in the color printer, the problem still occurs due to the leakage current as in the case of the tandem-type copier. To prevent this problem from occurring, the voltage standard values of the primary and secondary transfer rollers 61 and 66 are measured at one time while both of the constant-current power supplies 67 and 68 are turned on.

It should be obvious that both of the constant-current power supplies need to be turned on when the voltage standard value of only one of the primary and secondary transfer rollers 61 and 66 is measured.

Although the present invention has been fully described by way of examples with reference to the accompanying drawings, it is to be noted that various changes and modifications will be apparent to those skilled in the art.

Therefore, unless such changes and modifications depart from the scope of the present invention, they should be constructed as being included therein.

What is claimed is:

1. An image forming apparatus comprising:

an image holding system for holding toner images;

a plurality of transfer devices for transferring the toner images held on the image holding system onto a transfer medium;

a current supplying device for supplying a constant current to one of the plurality of transfer devices and to each of the plurality of transfer devices that is adjacent to the one of the plurality of transfer devices when a toner image transfer is not being performed by the plurality of transfer devices;

a detecting device for detecting a voltage across the one of the plurality of transfer devices when the constant current is supplied by the current supplying device; and a voltage setting device for setting a specific voltage to be applied to the one of the plurality of transfer devices in accordance with the voltage detected by the detecting device, the specific voltage being used for the toner image transfer.

2. The image forming apparatus of claim 1, wherein the current supplying device supplies the constant current to all of the plurality of transfer devices when a toner image transfer is not being performed by the plurality of transfer devices.

3. The image forming apparatus of claim 1, wherein the current supplying device supplies the constant current to the one of the plurality of transfer devices and to each of the plurality of transfer devices that is adjacent to the one of the plurality of transfer devices so that a time period when the constant current is supplied to the one of the plurality of transfer devices coincides with at least part of a time period when the constant current is supplied to each of the plurality of transfer devices that is adjacent to the one of the plurality of transfer devices, and wherein the detecting device detects a voltage across the one of the plurality of transfer devices while the time periods partially coincide with one another.

4. The image forming apparatus of claim 1, wherein each of the plurality of transfer devices includes an electrode contacting with the transfer medium, and the specific voltage is applied to the electrode.

5. The image forming apparatus of claim 1 further comprising a rotary belt for transporting the transfer medium, wherein the image holding system includes a plurality of toner image holding elements which are set corresponding to the plurality of transfer devices along a transportation path of the transfer medium transported by the rotary belt, and wherein the transfer medium is a recording sheet, and toner images formed on the plurality of toner image holding elements are sequentially transferred by the plurality of transfer devices onto the recording sheet transported by the rotary belt.

6. The image forming apparatus of claim 1, wherein the transfer medium is a rotary belt, wherein the image holding system includes a plurality of toner image holding elements which are set corresponding to the plurality of transfer devices along a circumferential surface of the rotary belt in a rotational direction of the rotary belt, and wherein toner images formed on the plurality of toner image holding elements are sequentially transferred by the plurality of transfer devices onto the rotary belt.

7. An image forming apparatus comprising:

a first image holding component for holding a first toner image;

a second image holding component for holding a second toner image;

a first transfer device for transferring the first toner image from the first image holding component onto a transfer medium;

a second transfer device for transferring the second toner image from the second image holding component onto the transfer medium;

a current supplying device for supplying a constant current to the first transfer device and to the second transfer device when neither of the first transfer device nor the second transfer device is performing a toner image transfer;

a detecting device for detecting a voltage across the first transfer device when the constant current is supplied by the current supplying device; and a voltage setting device for setting a specific voltage to be applied to the first transfer device in accordance with the voltage detected by the detecting device, the specific voltage being used for the toner image transfer.

8. The image forming apparatus of claim 7, wherein the current supplying device supplies the constant current to the first transfer device and to the second transfer device so that a time period when the constant current is supplied to the first transfer device coincides with at least part of a time period when the constant current is supplied to the second transfer device, and wherein the detecting device detects a voltage across the first transfer device while the time periods partially coincide with one another.

9. The image forming apparatus of claim 7, wherein the first transfer device includes a first electrode contacting with the transfer medium and the specific voltage is applied to the first electrode, and wherein the second transfer device includes a second electrode contacting with the transfer medium and the specific voltage is applied to the second electrode.

10. An image forming apparatus comprising:

an image holding component for holding a toner image;

a transfer medium;

a first transfer device for transferring the toner image from the image holding component onto the transfer medium;

a second transfer device for transferring the toner image formed on the transfer medium onto a record medium;

a current supplying device for supplying a constant current to the first transfer device and to the second transfer device when neither of the first transfer device nor the second transfer device is performing a toner image transfer;

a detecting device for detecting a voltage across the first transfer device when the constant current is supplied by the current supplying device; and a voltage setting device for setting a specific voltage to be applied to the first transfer device in accordance with the voltage detected by the detecting device, the specific voltage being used for the toner image transfer.

11. The image forming apparatus of claim 10, wherein the current supplying device supplies the constant current to the first transfer device and to the second transfer device so that a time period when the constant current is supplied to the first transfer device coincides with at least part of a time period when the constant current is supplied to the second transfer device, and wherein the detecting device detects a voltage across the first transfer device while the time periods partially coincide with one another.

12. A constant voltage setting method of setting a constant voltage for an image forming apparatus in which toner images formed on an image holding system are sequentially transferred onto a transfer medium by a plurality of transfer devices to which the constant voltage is applied, the constant voltage setting method including:

a first step for supplying a constant current to one of the plurality of the transfer devices which is subject to a voltage setting and to each of the plurality of the transfer devices which is adjacent to the one of the plurality of transfer devices;

a second step for detecting a voltage across the one of the plurality of transfer devices which is subject to the voltage setting when the constant current is supplied; and a third step for setting the constant voltage to be applied to the one of the plurality of transfer devices which is subject to the voltage setting in accordance with the voltage detected in the second step.

13. A constant voltage setting method of setting a constant voltage to be applied to a first transfer device of an image forming apparatus, in which a first toner image formed on a first image holding component is transferred onto a transfer medium by the first transfer device and a second toner image formed on a second image holding component is transferred onto the transfer medium by a second transfer device, with the constant voltage being applied to the first transfer device and the second transfer device, the constant voltage setting method including:

a first step for supplying a constant current to the first transfer device and the second transfer device;

a second step for detecting a voltage across the first transfer device when the constant current is supplied; and a third step for setting the constant voltage to be applied to the first transfer device in accordance with the voltage detected in the second step.

14. A constant voltage setting method of setting a constant voltage for an image forming apparatus, in which a toner image formed on an image holding component is transferred onto a transfer medium by a first transfer device and the toner image formed on the transfer medium is transferred onto a record medium by a second transfer device, with the constant voltage being applied to the first transfer device and the second transfer device, the constant voltage setting method including:

a first step for supplying a constant current to the first transfer device and the second transfer device;

a second step for detecting at least one of voltages across the first transfer device and the second transfer device when the constant current is supplied; and a third step for setting, in accordance with the voltage detected in the second step, the constant voltage to be applied to the at least one of the first transfer device and the second transfer device that is subjected to the detection in the second step.

* * * * *